US007868851B2

(12) United States Patent
Lee

(10) Patent No.: US 7,868,851 B2
(45) Date of Patent: Jan. 11, 2011

(54) PLASMA DISPLAY APPARATUS AND DRIVING METHOD THEREOF

(75) Inventor: Byeong Uk Lee, Bucheon-si (KR)

(73) Assignee: LG Electronics Inc., Seoul (KR)

( * ) Notice: Subject to any disclaimer, the term of this patent is extended or adjusted under 35 U.S.C. 154(b) by 1261 days.

(21) Appl. No.: 11/406,230

(22) Filed: Apr. 19, 2006

(65) Prior Publication Data

US 2007/0132666 A1 Jun. 14, 2007

(30) Foreign Application Priority Data

Dec. 12, 2005 (KR) ..... 10-2005-0122207

(51) Int. Cl.
*G09G 3/28* (2006.01)

(52) U.S. Cl. ..... 345/60; 345/67; 315/169.1

(58) Field of Classification Search ..... 345/60–68; 315/169.1–169.4

See application file for complete search history.

(56) References Cited

U.S. PATENT DOCUMENTS 6,188,374 B1 * 2/2001 Moon ..... 345/60
6,680,716 B2 * 1/2004 Nakamura ..... 345/60
6,972,740 B2 * 12/2005 Lee et al. ..... 345/60
7,053,559 B2 * 5/2006 Kim et al. ..... 315/169.3
2003/0122739 A1 * 7/2003 Araki ..... 345/60
2005/0168404 A1 8/2005 Ogawa et al.
2006/0022903 A1 * 2/2006 Moon ..... 345/60
2006/0103600 A1 * 5/2006 Chang et al. ..... 345/67
2007/0115218 A1 * 5/2007 Lim ..... 345/67

FOREIGN PATENT DOCUMENTS

EP 1 274 064 6/2002
KR 10-2004-0021363 A 3/2004

OTHER PUBLICATIONS

European Search Report dated Sep. 30, 2009.

* cited by examiner

*Primary Examiner*—Kimnhung Nguyen
(74) *Attorney, Agent, or Firm*—KED & Associates, LLP

(57) ABSTRACT

The present invention relates to a plasma display apparatus and driving method thereof. The plasma display apparatus according to an embodiment of the present invention comprises a plasma display panel comprising a scan electrode and a sustain electrode, and a driver that controls one or more of sustain pulses supplied to the scan electrode and one or more of sustain pulses supplied to the sustain electrode to be overlapped with each other.

15 Claims, 5 Drawing Sheets

(a)

(b)

PLASMA DISPLAY APPARATUS AND DRIVING METHOD THEREOF

This Nonprovisional application claims priority under 35 U.S.C. §119(a) on Patent Application No. 10-2005-0122207 filed in Korea on Dec. 12, 2006, the entire contents of which are hereby incorporated by reference.

BACKGROUND OF THE INVENTION

1. Field of the Invention

The present invention relates to a display apparatus. More particularly, the present invention relates to a plasma display apparatus and driving method thereof.

2. Discussion of Related Art

In the recent information society, display devices have been in the spotlight as visual information transfer media. In recent years, a cathode ray tube or a Braun tube becoming the mainstream is problematic in the heavy weight and bulky size. Various kinds of panel displays which can overcome the limitations of the cathode ray tube have been developed.

The flat panel displays may include a liquid crystal display apparatus, a plasma display apparatus, a field emission display apparatus, an electro-luminescence device and so on.

The plasma display apparatus of the flat panel displays has a plasma display panel and a driver for driving the plasma display panel. The plasma display apparatus displays images and motion pictures including characters and/or graphics by exciting phosphors with ultraviolet rays of 147 nm generated during the discharge of a gas such as He+Xe, Ne+Xe or He+Xe+Ne within the plasma display panel. The plasma display apparatus can be easily made thin and large, and it can provide greatly increased image quality with the recent development of the relevant technology.

More particularly, a three-electrode AC surface discharge type plasma display apparatus has the advantages of lower voltage driving and longer product lifespan since wall charges are accumulated using a dielectric layer upon discharge, resulting in a low discharge voltage, and electrodes are protected from sputtering of plasma.

FIG. 1 illustrates driving pulses supplied to electrodes of a plasma display panel in the sustain period in the related art.

As shown in FIG. 1, in the sustain period, a sustain pulse (sus) is alternately applied to a scan electrode Y and a sustain electrode Z. Sustain discharge (i.e., display discharge) is generated between the scan electrode Y and the sustain electrode Z in a cell selected by address discharge whenever the sustain pulse (sus) is applied to the cell as a wall voltage within the cell and a voltage by the sustain pulse (sus) are added.

A driving apparatus that supplies such a sustain pulse is problematic in that erroneous discharge is not improved at the outer corner of the plasma display panel.

This is because the outer corner of the plasma display panel is greatly influenced by a poor exhaust and sintering in the manufacturing process of the plasma display panel.

Therefore, erroneous discharge is more generated in the outer corner portion of the plasma display panel than in the central portion of the plasma display panel since it is difficult to predict a discharge firing voltage during sustain discharge.

Erroneous discharge is particularly problematic in the region with a low Average Picture Level (hereinafter, referred to as "APL"). This is because the lower the APL, the smaller the number of discharge cells contributing to display discharge in the sustain period. Furthermore, since the number of sustain pulses increases, luminance of a discharge cell, which generates display discharge, becomes high.

If erroneous discharge is generated in the region with a low APL, it looks that erroneous discharge is generated in discharge cells, which are greater in number than those in which erroneous discharge is generated in the region with a high APL and brighter erroneous discharge is displayed. This can be more clearly seen by a viewer.

Accordingly, a problem arises because the picture quality is further degraded due to erroneous discharge.

SUMMARY OF THE INVENTION

Accordingly, an object of the present invention is to solve at least the problems and disadvantages of the background art.

The present invention provides a plasma display apparatus and driving method thereof, in which the occurrence of erroneous discharge when a plasma display panel is driven can be prevented.

A plasma display apparatus according to an embodiment of the present invention comprises a plasma display panel comprising a scan electrode and a sustain electrode, and a driver for controlling one or more sustain pulses supplied to the scan electrode and one or more sustain pulses supplied to the sustain electrode to be overlapped with each other.

A plasma display apparatus according to another embodiment of the present invention comprises a plasma display panel comprising a scan electrode and a sustain electrode, and a driver for applying the highest voltage of the last sustain pulse supplied to the sustain electrode while the highest voltage of the last sustain pulse supplied to the scan electrode in a sustain period is sustained.

A driving method of a plasma display apparatus in which a plurality of sub-fields are driven with it being divided into a reset period, an address period and a sustain period comprises the steps of supplying a scan pulse to a scan electrode in an address period, and causing one or more sustain pulses supplied to the scan electrode and one or more sustain pulses supplied to a sustain electrode in a sustain period subsequent to the address period to overlap with each other.

The present invention is advantageous in that it can reduce the occurrence of erroneous discharge when a plasma display panel is driven and it can improve the picture quality of the plasma display apparatus.

BRIEF DESCRIPTION OF THE DRAWINGS

A more compete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Figure 1:
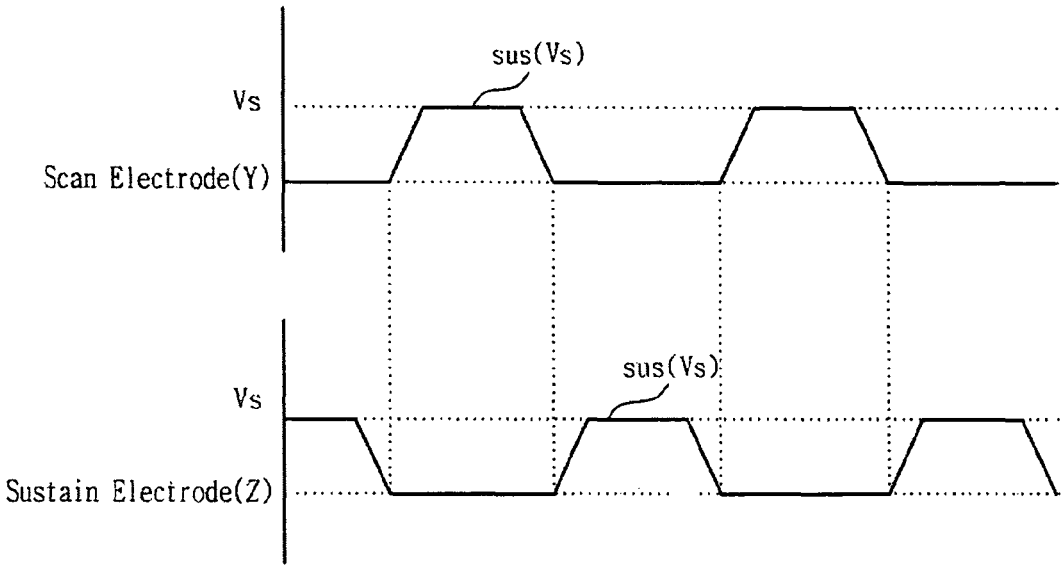
FIG. 1 illustrates driving pulses supplied to electrodes of a plasma display panel in the sustain period in the related art.

In the following detailed description, only certain exemplary embodiments of the present invention have been shown and described simply by way of illustration. As those skilled in the art will realize, the described embodiment may be modified in various different ways, all without departing from the spirit or scope of the present invention. Accordingly, the drawings and description are to be regarded as illustrative in nature and not restrictive. Like reference numerals designate like elements throughout.

A plasma display apparatus according to an embodiment of the present invention comprises a plasma display panel comprising a scan electrode and a sustain electrode, and a driver for controlling one or more sustain pulses supplied to the scan electrode and one or more sustain pulses supplied to the sustain electrode to be overlapped with each other.

The driver controls the number of sustain pulses that are overlapped with each other, according to a reference APL of one frame.

The sustain pulses are overlapped with each other, when the number of cells in an on state is 20% or less of all of the cells in one frame.

The driver ensures that the last sustain pulse supplied to the scan electrode and the last sustain pulse supplied to the sustain electrode overlap with each other.

A width of the last sustain pulse supplied to the scan electrode and a width of the last sustain pulse supplied to the sustain electrode are different from each other.

The width of the last sustain pulse supplied to the scan electrode is wider than the width of the last sustain pulse supplied to the sustain electrode.

The width of the last sustain pulse supplied to the scan electrode ranges from 1.2 to 1.8 times wider than the width of the last sustain pulse supplied to the sustain electrode.

A length of a period where the last sustain pulse supplied to the scan electrode and the last sustain pulse supplied to the sustain electrode overlap with each other ranges from 0.2 to 0.3 times narrower than the width of the last sustain pulse supplied to the scan electrode.

Hereinafter, a plasma display apparatus and driving method thereof according to an embodiment of the present invention will be described with reference to the accompanying drawings.

Figure 2:
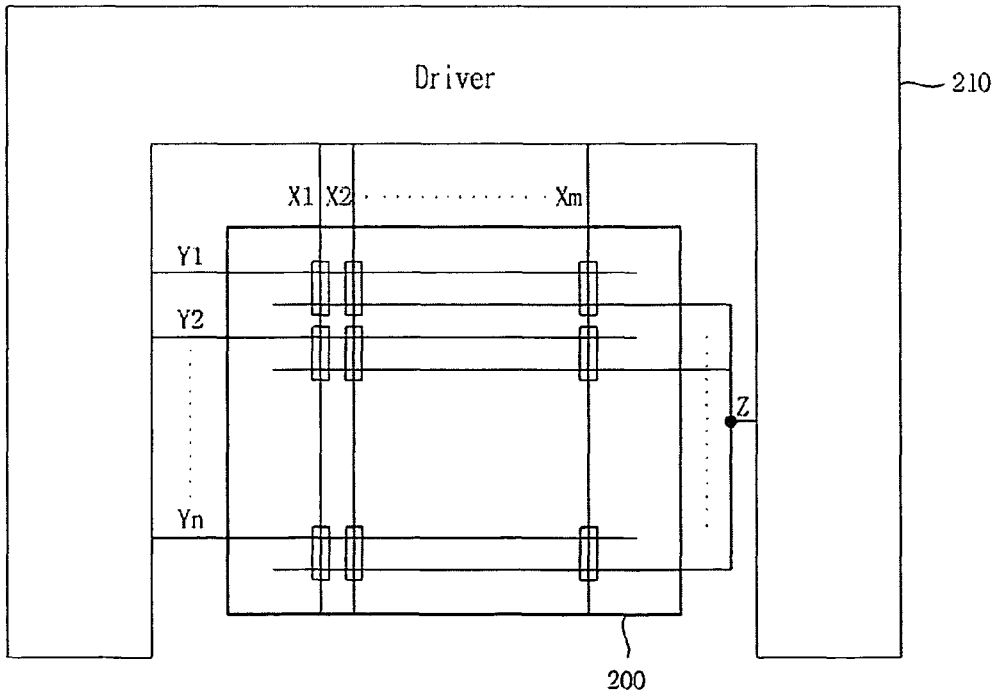
FIG. 2 shows the construction of a plasma display apparatus according to an embodiment of the present invention.

FIG. 2 shows the construction of a plasma display apparatus according to an embodiment of the present invention.

As shown in FIG. 2, the plasma display apparatus according to an embodiment of the present invention comprises a plasma display panel 200 and a driver 210 for driving the plasma display panel.

The plasma display panel 200 comprises scan electrodes $Y_1$ to Yn, a sustain electrode Z, and a plurality of address electrodes $X_1$ to Xm crossing the scan electrodes $Y_1$ to Yn and the sustain electrode Z.

The driver 210 of the plasma display panel 200 drives the plasma display panel 200 by supplying a driving pulse, which is suitable for the property of each electrode, to the sustain electrode Z and the scan electrodes $Y_1$ to Yn, and the plurality of address electrodes $X_1$ to Xm crossing the sustain electrode Z.

More particularly, in supplying the driving pulses to the plasma display panel 200, the driver 210 of the plasma display apparatus according to the present invention supplies one or more sustain pulses to the scan electrodes $Y_1$ to Yn and the sustain electrode Z, respectively, in the sustain period.

Furthermore, the driver 210 causes one or more of the sustain pulses supplied to the scan electrodes $Y_1$ to Yn to be overlapped with one or more of the sustain pulses supplied to the sustain electrode Z. To the contrary, the driver 210 causes one or more of the sustain pulses supplied to the sustain electrode Z to be overlapped with one or more of the sustain pulses supplied to the scan electrodes $Y_1$ to Yn.

When the sustain pulses supplied to the scan electrodes or the sustain electrode are overlapped with one another, the number of turn-on cells of the entire cells in one frame, which are displayed as an image in the plasma display panel, is 20% or less. It has been described above that the number of turn-on cells of the entire cells in one frame, which are displayed as an image in the plasma display panel, is 20% or less. It is however to be understood that the number may be varied depending on a discharge characteristic of the plasma display panel.

It has also been described above that the number of sustain pulses, which are overlapped with one another, of the sustain pulses supplied to the scan electrodes $Y_1$ to Yn and the sustain electrode Z is one or more. It is however to be understood that the number may be varied depending on a reference APL of one frame.

For example, it is assumed that the number of sustain pulses overlapped in the reference APL of the plasma display apparatus is 10. In this case, if the APL is higher than the reference APL when the plasma display panel is driven, the number of sustain pulses, which are overlapped with one another, of sustain pulses supplied to the scan electrodes and the sustain electrode, is 10 or higher. If the APL is lower than the reference APL, the number of sustain pulses, which are overlapped with one another, of sustain pulses supplied to the scan electrodes and the sustain electrode, is 10 or lower.

The number of sustain pulses overlapped depending on the reference APL may be varied depending on a discharge characteristic of the plasma display panel. In other words, even though the APL is the reference APL when the plasma display panel is driven, the number of overlapping sustain pulses can be 0.

The reason why the sustain pulses supplied to the scan electrodes and the sustain electrode in the sustain period are overlapped with one another according to the reference APL as described above will be described below with reference to driving pulses in the driving method of the plasma display apparatus according to the present invention.

Figure 3:
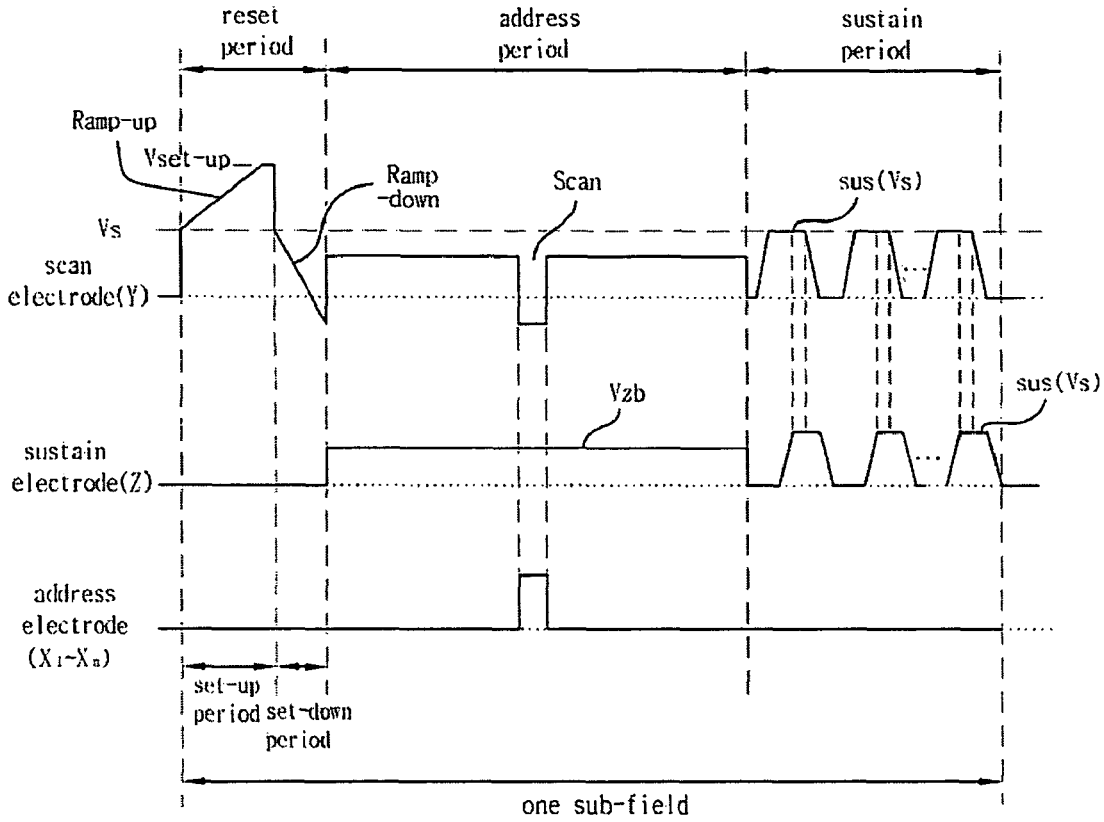
FIG. 3 illustrates an example of driving pulses in the driver shown in FIG. 2.

FIG. 3 illustrates an example of driving pulses in the driver shown in FIG. 2.

As shown in FIG. 3, the driver 210 of the plasma display apparatus according to the present invention supplies respective driving pulses to the plasma display panel in a reset period for initializing the entire cells, an address period for selecting a cell to be discharged and a sustain period for sustaining the discharge of a selected cell.

In a set-up period of the reset period, the driver 210 applies a ramp-up pulse (Ramp-up) to the entire scan electrodes $Y_1$ to Yn at the same time. The ramp-up pulse causes a weak discharge to occur in the discharge cells of the panel. Accordingly, wall charges are uniformly accumulated on the entire discharge cells of the plasma display panel in a saturation state.

In the set-down period of the reset period, the driver 210 supplies a ramp-down pulse (Ramp-down), which falls from a voltage of a sustain voltage (Vs) level to a particular voltage (−Vy') level, to the scan electrode $Y_1$ to Yn. At this time, positive polarity wall charges and negative polarity wall charges within the cells are sufficiently erased since erase discharge is generated between the scan electrodes $Y_1$ to Yn and the address electrodes $X_1$ to Xm.

In the address period, the driver 210 applies a voltage, which rises from a particular voltage (−Vy') level as much as a voltage (Vsc), to the scan electrodes $Y_1$ to Yn and then applies a negative scan pulse, which falls from a voltage (Vsc') level to a voltage (−Vy) level, to the scan electrodes $Y_1$ to Yn sequentially. The driver 210 also applies a positive address pulse (Scan) to the address electrodes $X_1$ to Xm in synchronization with the scan pulse. As a voltage difference between the scan pulse and the address pulse and a wall voltage generated in the reset period are added, address discharge is generated within discharge cells supplied to the address pulse. Accordingly, wall charges of the degree in which a discharge can be generated when the sustain voltage (Vs) is applied are formed within cells selected by the address discharge.

Furthermore, the driver 210 applies a positive bias pulse (Vzb) to the sustain electrode Z during the address period such that erroneous discharge is not generated by reducing a voltage difference between the scan electrodes $Y_1$ to Yn and the sustain electrode Z.

In the sustain period subsequent to the address period, the driver 210 supplies one or more sustain pulses to the scan electrodes $Y_1$ to Yn and the sustain electrode Z, respectively. The driver 210 also causes the sustain pulses, which are supplied to the scan electrodes $Y_1$ to Yn and the sustain electrode Z, to be overlapped with one another according to an APL.

The reason can be described as follows. In general, a set-up voltage of a rising ramp applied in the reset period in order to drive the plasma display panel is high. If such a high set-up voltage (Vset-up) is used, the contrast ratio becomes worse. If the set-up voltage (Vset-up) becomes high, a strong dark discharge can be generated and spot erroneous discharge can be generated accordingly.

Therefore, the driver of the plasma display apparatus according to the present invention uses a low set-up voltage (Vset-up) in order to lower such a spot erroneous discharge. If the set-up voltage (Vset-up) is lowered, however, an amount of wall charges accumulated on the discharge cells in the set-up period decreases and an amount of wall charges erased in the set-down (Set-down) period is reduced that much.

If wall charges are not sufficiently accumulated on each discharge cell in the reset period to the extent necessary for a discharge in the address period, address discharge is not properly generated. Accordingly, cells that should be turned on in the sustain period are not properly turned on, resulting in the occurrence of erroneous discharge.

Erroneous discharge is more frequently generated at the outer corner of the plasma display panel than at the central portion of the plasma display panel. This is because the central portion of the plasma display panel is rarely influenced by thermal deformation upon sintering of the panel in the manufacturing process, exhaust and so on, but the outer corner of the plasma display panel is accumulated with impurity gases upon exhaust and is also thermally deformed upon sintering.

It is therefore required that wall charges be sufficiently accumulated within the entire discharge cells of the plasma display panel in order to compensate for erroneous discharge occurring at the outer corner of the plasma display panel. A method of raising the set-up voltage (Vset-up) may be suitable for sufficiently accumulating wall charges on the cells. In this method, however, the above-mentioned spot erroneous discharge can be generated at the front of the panel due to the high set-up voltage (Vset-up). Accordingly, it is preferred that the set-up voltage (Vset-up) keep intact and the sustain pulses be overlapped with one another.

In the case where the sustain pulses are overlapped with one another as described above, the set-up voltage (Vset-up) can be further lowered while controlling erroneous discharge that may occur at the outer corner of plasma display panel compared with the case where the sustain pulses are not overlapped.

Meanwhile, erroneous discharge that is generated when the plasma display panel is driven is more visible to the eyes of a viewer at a low APL rather than a high APL. This will be described below with reference to FIG. 4.

Figure 4:
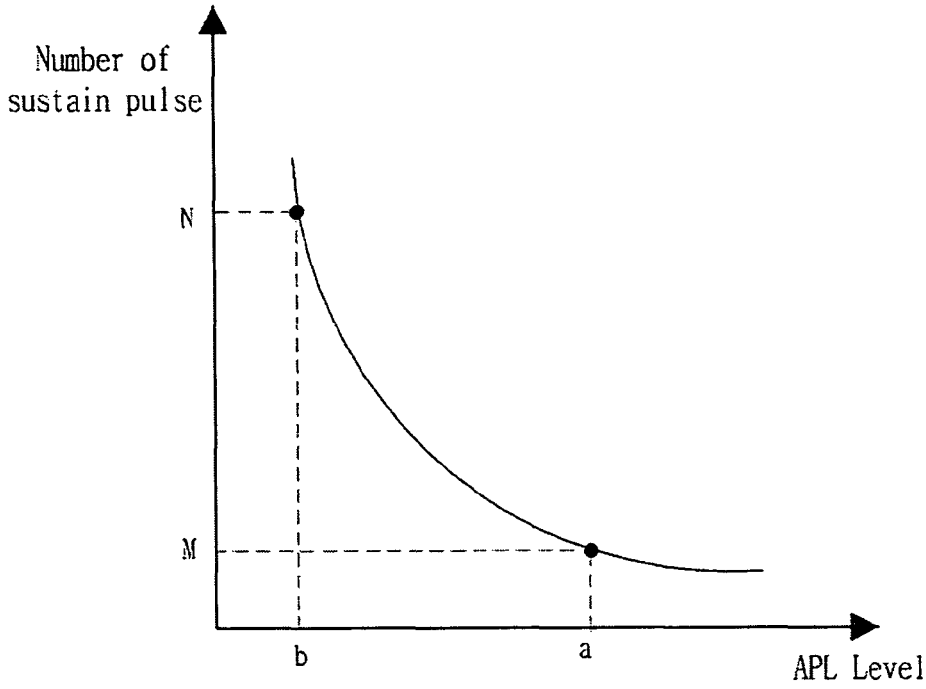
FIG. 4 is a view illustrating the APL of the plasma display apparatus according to the present invention.
Figure 4:
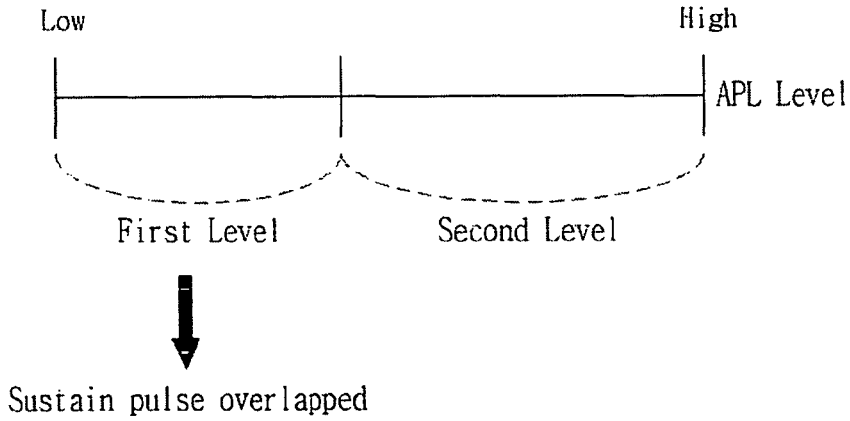

FIG. 4 is a view illustrating the APL of the plasma display apparatus according to the present invention.

As shown in FIG. 4(*a*), when a plasma display panel is driven, the number of sustain pulses supplied to the scan electrodes or the sustain electrode increases as a value of the APL decided according to the number of discharge cells that are turned on, of discharge cells of the plasma display panel, but decreases as the value of the APL decreases.

For example, in the event that an image is displayed at a relatively large area on the screen of the plasma display panel, i.e., in the case where an area on which an image is displayed is relatively large (in this case, an APL level is relatively high), the number of discharge cells contributing to the display of the image is relatively high. Accordingly, the entire power consumption amount of the plasma display panel can be reduced y relatively decreasing the number of sustain pulses per unit gray scale, which are respectively supplied to the discharge cells contributing to the display of the image.

On the contrary, in the event that an image is displayed at a relatively small area on the screen of the plasma display panel, i.e., in the case where an area on which an image is displayed is relatively small (in this case, an APL level is relatively low), the number of discharge cells contributing to the display of the image is relatively low. Therefore, the number of sustain pulses per unit gray scale, which are respectively supplied to the discharge cells contributing to the display of the image, becomes relatively many, thereby increasing luminance at the area where the image is displayed. Accordingly, an abrupt increase in the entire power consumption amount can be prevented while improving an overall picture quality of the plasma display panel 200.

In more detail, in FIG. 4(*a*), assuming that when the APL is a "b" level, the number of the sustain pulses per unit gray scale is "N" and when the APL is an "a" level-higher than the "b" level, the number of the sustain pulses per unit gray scale is "M" smaller than "N", the number of sustain pulses representing the same gray scale can be varied when the APLs are different in the same gray scale.

Accordingly, as shown in FIG. 4(*b*), the driver of the plasma display apparatus according to the present invention causes the sustain pulses in the sustain period to be overlapped with one another in a first level whose ALP is lower than that of a second level.

This is because erroneous discharge occurring in the first level with the low APL can be more easily seen to a viewer than erroneous discharge occurring in the second level with the high APL.

The reason why erroneous discharge is more easily seen to a viewer in the first level with the low APL as described above can be described as follows. When the number of discharge cells where erroneous discharge is generated is the same, the number of discharge cells contributing to display discharge is smaller in the first level than in the second level. Therefore, the number of discharge cells where erroneous discharge is generated in the first level looks relatively many. As a result, erroneous discharge is more easily seen to the eyes of a viewer and the picture quality looks poor accordingly. Furthermore, in the case where the same gray scale is represented, brighter representation can be accomplished since the number of sustain pulses is greater in the first level than in the second level. This is one of factors that make discharge cells causing erroneous discharge more easily seen to the eyes.

For the above reason, if erroneous discharge occurs in the first level with the low APL, it looks that more discharge cells generate erroneous discharge more brightly in the second level. It has an adverse affect on the picture quality.

At this time, it is preferred that the first level be within a range of lower 20% of the entire APL.

It is preferred that the sustain pulses be overlapped with one another in the APL of the low region. The overlapping sustain pulses will be described in more detail with reference to FIG. 5.

Figure 5:
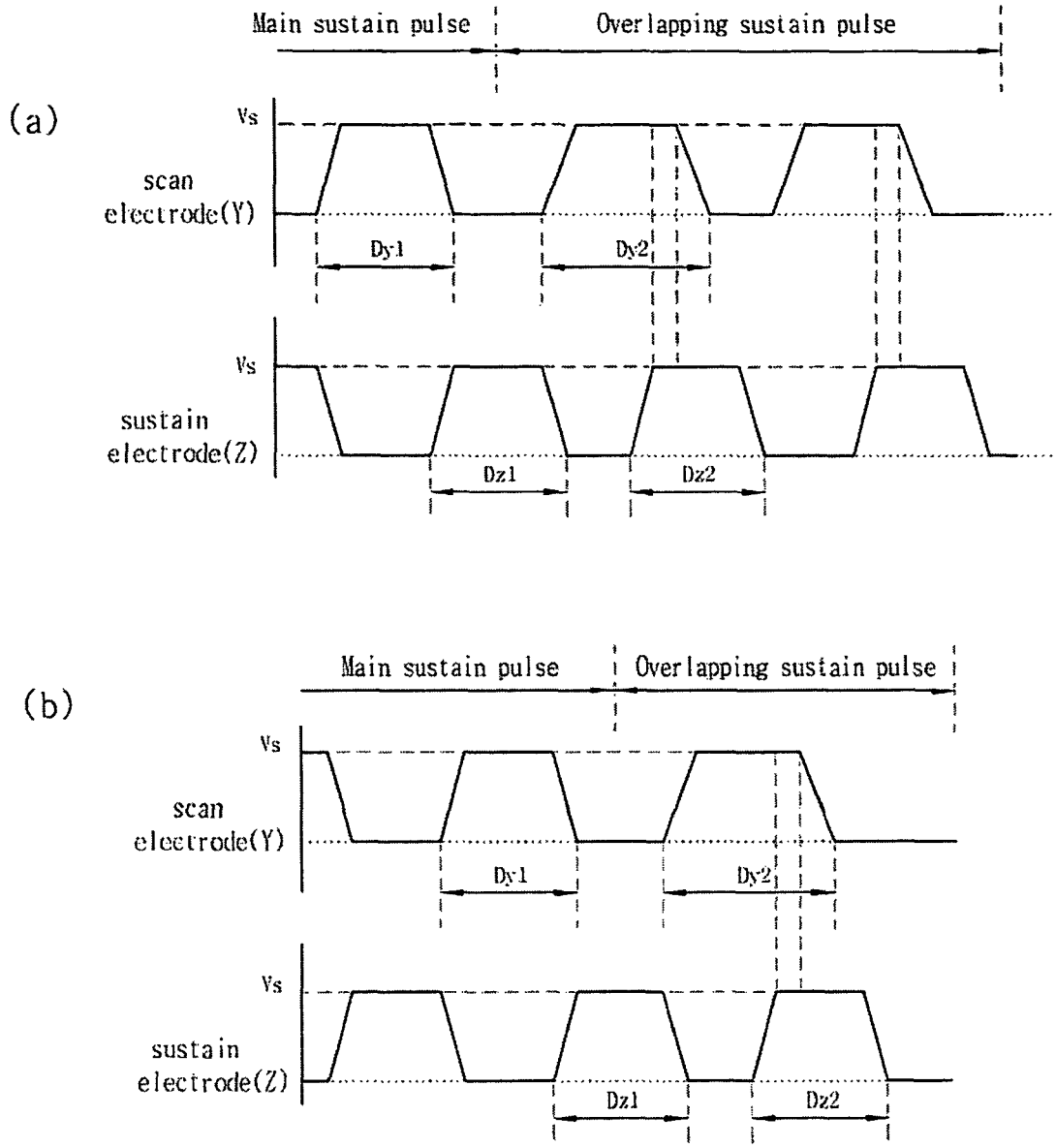
FIG. 5 illustrates an example of sustain pulses in the example of the driving pulses shown in FIG. 3.

FIG. 5 illustrates an example of sustain pulses in the example of the driving pulses shown in FIG. 3.

As shown in FIG. 5(*a*), to compensate for a low set-up voltage, it is preferred that some of the entire sustain pulses are overlapped in an APL of a low region.

The entire sustain pulses supplied in the sustain period can be overlapped as shown in FIG. 3. If the entire sustain pulses supplied in the sustain period are overlapped, however, erroneous discharge in an APL of a low level can be reduced, but peaking may be generated in a real waveform due to physical reason and EMI can also be generated. For this reason, only some of the entire sustain pulses are overlapped as shown in FIG. 5(*a*) in order not to burden the circuit while keeping the effects on erroneous discharge intact.

Meanwhile, as shown in FIG. 5(*a*), the sustain pulses may be classified into main sustain pulses, which are not overlapped with each other and are alternately supplied to the scan electrode Y and the sustain electrode z, and overlapping sustain pulses in which one or more of the sustain pulses supplied to the scan electrode Y and one or more of the sustain pulse supplied to the sustain electrode Z are overlapped with each other.

Referring to FIG. 5(*a*), in the main sustain pulses, a width (Dy1) of the main sustain pulse supplied to the scan electrode Y and a width (Dy2) of the main sustain pulse supplied to the sustain electrode Z are identical to each other. Furthermore, a voltage (Vs) of the main sustain pulse supplied to the scan electrode Y and a voltage (Vs) of the main sustain pulse supplied to the sustain electrode Z are identical to each other.

On the other hand, in the overlapping sustain pulses, a voltage (Vs) of the overlapping sustain pulse is the same as the voltage (Vs) of the main sustain pulse. A width (Dz2) of the overlapping sustain pulse supplied to the sustain electrode Z is the same as the widths (Dy1, Dz1) of the main sustain pulse. The width (Dy2) of the overlapping sustain pulse supplied to the scan electrode Y is wider than that of the overlapping sustain pulse supplied to the sustain electrode. As shown in FIG. 5(*a*), each of the sustain pulses applied to the scan and sustain electrodes has a ramp-up portion, a peak voltage portion, and a ramp-down portion. The peak voltage portion of at least one of the sustain pulses applied to the scan electrode Y overlaps the peak voltage portion of at least one of the sustain pulses applied to the sustain electrode Z. Stated differently, the driver 210 applies a highest voltage of at least one of the sustain pulses to the sustain electrode Z while applying a highest voltage of at least one of the sustain pulses to the scan electrode Y.

This is because the sustain pulses may cause wall charges formed within the discharge cells to be erased according to a width and voltage of the sustain pulse and wall charges to be accumulated within the discharge cells to a greater extent. Accordingly, the main sustain pulse having display discharge as a main purpose is set to have a critical width and a critical voltage where wall charges are not erased and accumulated using the characteristic. Furthermore, the overlapping sustain pulses for compensating for the set-up (Yset-up) voltage as well as display discharge are set to have a width wider than the critical width of the main sustain pulse so that wall charges are accumulated.

FIG. 5(*b*) illustrates that the last sustain pulse of the sustain pulses supplied to the scan electrode Y and the last sustain pulse of the sustain pulses supplied to the sustain electrode Z are overlapped with each other, unlike FIG. 5(*a*).

The reason why the last sustain pulses of the sustain pulses are overlapped with each other as described above is the same as that described with reference to FIG. 5(*a*). That is, a burden on the circuit or EMI due to peaking of a pulse can be minimized by reducing the number of the overlapping sustain pulses. Furthermore, erroneous discharge occurring on the plasma display panel can be minimized by directly assisting the role of a ramp-up pulse of a low set-up voltage subsequent to the last sustain pulse.

At this time, it is preferred that a width (Dy2) of the last sustain pulse supplied to the scan electrode Y and a width (Dz2) of the last sustain pulse supplied to the sustain electrode Z be different from each other. It is more preferred that the width (Dy2) of the last sustain pulse supplied to the scan electrode Y is wider than the width (Dz2) of the last sustain pulse supplied to the sustain electrode Z.

The reason why the width (Dy2) of the last sustain pulse supplied to the scan electrode Y is set to be wide as described above can be described as follows. That is, the width (Dy2) of the last overlapping sustain pulse is set wider than the width (Dy1, Dz1) of the main sustain pulse so that wall charges are accumulated within the discharge cells. If more wall charges are accumulated within the discharge cells by the ramp-up pulse subsequent to the last sustain pulse in addition to the wall charges accumulated within the discharge cells as described above, wall charges can be accumulated within the discharge cells at the corner portion of the plasma display panel in a saturation state. If wall charges are sufficiently accumulated within the discharge cells as described above, address discharge can properly occur in the address period, thus preventing erroneous discharge.

The last sustain pulse mentioned above will be described in more detail with reference to FIG. 6.

Figure 6:
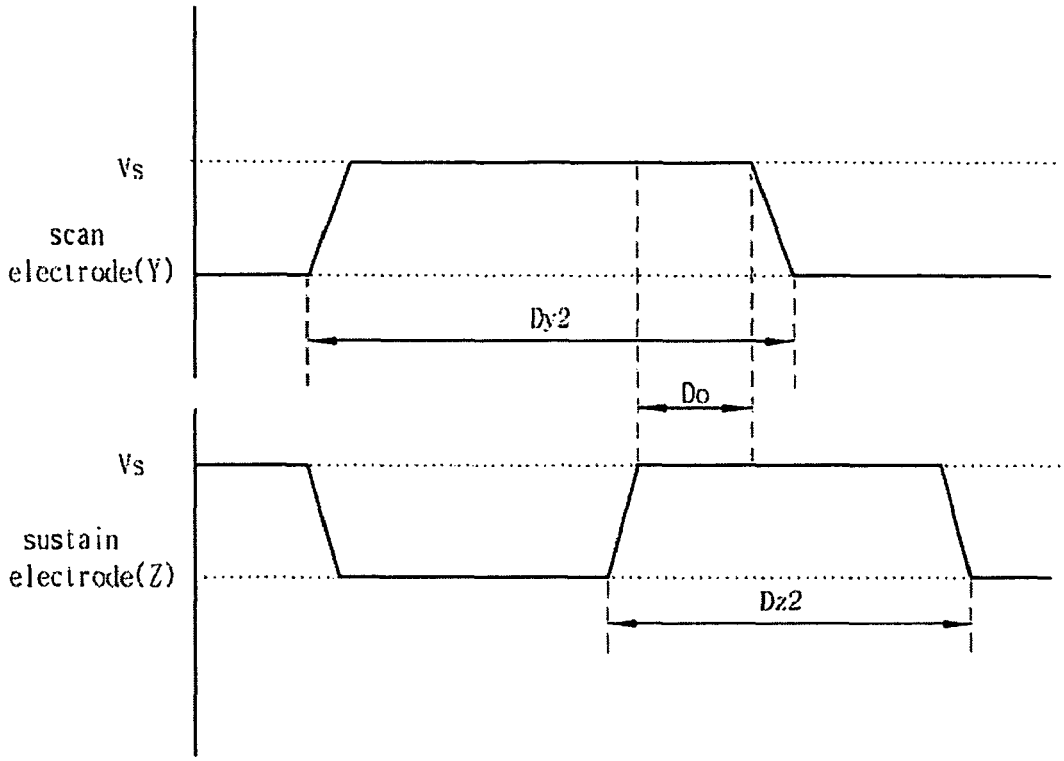
FIG. 6 illustrates the last overlapping sustain pulse in the sustain pulse shown in FIG. 5(*b*).

FIG. 6 illustrates the last overlapping sustain pulse in the sustain pulse shown in FIG. 5(*b*).

As shown in FIG. 6, a voltage of the last sustain pulse supplied to the sustain electrode Z in one sub-field is applied while the highest voltage of the sustain pulse that is finally supplied to the scan electrode Y is sustained.

In more detail, the lowest voltage of the last sustain pulse supplied to the scan electrode is supplied while the highest voltage of the last sustain pulse supplied to the sustain electrode is sustained.

At this time, a width (Dy2) of the last sustain pulse supplied to the scan electrode Y is preferably 1.2 to 1.8 times smaller than a width (Dz2) of the last sustain pulse supplied to the sustain electrode Z.

In an example in which the width (Dz2) of the last sustain pulse supplied to the sustain electrode Z is the same as a width of the main sustain pulse, it is assumed that the width (Dz2) of the last sustain pulse supplied to the sustain electrode Z has a width of a critical pulse in which wall charges within the discharge cells are not erased and accumulated by the sustain pulse. Under such assumption, it means that the width (Dy2)

of the last sustain pulse supplied to the scan electrode Y is 1.2 to 1.8 times smaller than the width of the main sustain pulse.

The reason why the width (Dy2) of the last sustain pulse supplied to the scan electrode Y is set to be 1.2 to 1.8 times smaller than the width of the main sustain pulse can be described as follows.

If the width (Dy2) of the last sustain pulse supplied to the scan electrode Y is 1.2 times smaller than the width of the main sustain pulse, a width that increases in the last sustain pulse becomes too narrow. This means that energy of the sustain pulse that may affect an increase in wall charges is insignificant that much. Therefore, if the width (Dy2) of the last sustain pulse supplied to the scan electrode Y is 1.2 times smaller than the width of the main sustain pulse, wall charges cannot be properly formed. This is because the width (Dy2) of the last sustain pulse supplied to the scan electrode Y is 1.2 times greater than the width of the main sustain pulse. Furthermore, if the width (Dy2) of the last sustain pulse supplied to the scan electrode Y is 1.8 times greater than the width of the main sustain pulse, an overall driving duration of the sustain pulse is lengthened and driving margin may be lowered accordingly. It is thus preferred that the width (Dy2) of the last sustain pulse supplied to the scan electrode Y is 1.8 times smaller than the width of the main sustain pulse.

Furthermore, the length of a period where the last sustain pulse supplied to the scan electrode Y and the last sustain pulse supplied to the sustain electrode Z are overlapped with each other is preferably 0.2 to 0.3 times smaller than the width of the last sustain pulse supplied to the scan electrode Y. The length of a period where the last sustain pulse supplied to the scan electrode Y and the last sustain pulse supplied to the sustain electrode Z are overlapped with each other is preferably 0.25 to 0.35 times smaller than the width of the last sustain pulse supplied to the sustain electrode Z.

What the length of the overlapped period becomes long means that a voltage of the same positive polarity is applied to the scan electrode Y and the sustain electrode Z at the same time. This is because if the period is lengthened, wall charges may not be accumulated and a problem may occur in the circuit. Accordingly, the length of the overlapped period should be properly controlled by the sustain pulse.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display apparatus comprising:

a plasma display panel having a scan electrode and a sustain electrode; and a driver for overlapping a peak voltage portion of at least one of sustain pulses supplied to the scan electrode with a peak voltage portion of at least one of sustain pulses supplied to the sustain electrode, wherein the driver ensures that a last sustain pulse supplied to the scan electrode and a last sustain pulse supplied to the sustain electrode overlap with each other, and wherein a width of the last sustain pulse supplied to the scan electrode is different from a width of the last sustain pulse supplied to the sustain electrode.

2. The plasma display apparatus as claimed in claim 1, wherein the driver controls a number of sustain pulses that are overlapped with each other based on a reference average picture level (APL) of one frame.

3. The plasma display apparatus as claimed in claim 1, wherein the sustain pulses are overlapped with each other, when a number of cells in an on state is 20% or less of all of the cells in one frame.

4. The plasma display apparatus as claimed in claim 1, wherein the width of the last sustain pulse supplied to the scan electrode is greater than the width of the last sustain pulse supplied to the sustain electrode.

5. The plasma display apparatus as claimed in claim 1, wherein the width of the last sustain pulse supplied to the scan electrode is 1.2 to 1.8 times greater than the width of the last sustain pulse supplied to the sustain electrode.

6. The plasma display apparatus as claimed in claim 1, wherein a length of a period when the last sustain pulse supplied to the scan electrode and the last sustain pulse supplied to the sustain electrode overlap with each other is 0.2 to 0.3 times smaller than the width of the last sustain pulse supplied to the scan electrode.

7. A plasma display apparatus comprising:

a plasma display panel having a scan electrode and a sustain electrode; and a driver for overlapping a peak voltage portion of a last sustain pulse applied to the sustain electrode with a peak voltage portion of a last sustain pulse applied to the scan electrode in a sustain period, wherein a width of the last sustain pulse applied to the scan electrode is different from a width of the last sustain pulse applied to the sustain electrode.

8. The plasma display apparatus as claimed in claim 7, wherein the width of the last sustain pulse applied to the scan electrode is greater than the width of the last sustain pulse applied to the sustain electrode.

9. The plasma display apparatus as claimed in claim 7, wherein a lowest voltage of the last sustain pulse is applied to the scan electrode while the highest voltage of the last sustain pulse is applied to the sustain electrode.

10. A driving method of a plasma display apparatus, comprising:

supplying a scan pulse to a scan electrode in an address period; and causing a peak voltage portion of at least one sustain pulse supplied to the scan electrode and a peak voltage portion of at least one sustain pulse supplied to a sustain electrode in a sustain period subsequent to the address period to overlap with each other, wherein a last sustain pulse supplied to the scan electrode and a last sustain pulse supplied to the sustain electrode overlap with each other, and wherein a width of the last sustain pulse supplied to the scan electrode is substantially same as a width of the last sustain pulse supplied to the sustain electrode.

11. The driving method as claimed in claim 10, wherein a number of sustain pulses that are overlapped with each other is controlled based on a reference average picture level (APL) of one frame.

12. The driving method as claimed in claim 10, wherein the sustain pulses are overlapped with each other, when a number of cells in an on state is 20% or less of all of the cells in one frame.

13. The driving method as claimed in claim 10, wherein a width of the last sustain pulse supplied to the scan electrode is greater than a width of the last sustain pulse supplied to the sustain electrode.

14. The driving method as claimed in claim 10, wherein a width of the last sustain pulse supplied to the scan electrode is 1.2 to 1.8 times greater than a width of the last sustain pulse supplied to the sustain electrode.

15. The driving method as claimed in claim 10, wherein a length of a period when the last sustain pulse supplied to the scan electrode and the last sustain pulse supplied to the sustain electrode overlap with each other is 0.2 to 0.3 times smaller than a width of the last sustain pulse supplied to the scan electrode.

* * * * *